US005942043A

United States Patent [19]

Suemune

[11] Patent Number: 5,942,043

[45] Date of Patent: Aug. 24, 1999

[54] METHOD OF CLEANING A PRINT HEAD USING A PLURALITY OF CLEANING OPERATIONS

[75] Inventor: Toshiro Suemune, Tokyo, Japan

[73] Assignee: Oki Data Corporation, Tokyo, Japan

[21] Appl. No.: 08/867,775

[22] Filed: Jun. 3, 1997

[30] Foreign Application Priority Data

Jun. 11, 1996 [JP] Japan ..... 8-149376

[51] Int. Cl.[6] ..... B08B 7/04; B41J 2/165

[52] U.S. Cl. ..... 134/18; 134/21; 134/42; 347/23; 347/30; 347/33

[58] Field of Search ..... 134/18, 21, 42; 347/22, 30, 33, 34, 23

[56] References Cited

U.S. PATENT DOCUMENTS

| | | | |
|---|---|---|---|
| 4,362,572 | 12/1982 | Wallace | 134/18 |
| 4,567,494 | 1/1986 | Taylor | 347/30 |
| 5,126,765 | 6/1992 | Nakanura | 347/33 |
| 5,565,898 | 10/1996 | Sakuma | 347/23 |

FOREIGN PATENT DOCUMENTS 7-9686 1/1995 Japan .

*Primary Examiner*—Jill Warden
*Assistant Examiner*—Saeed Chaudhry
*Attorney, Agent, or Firm*—Rabin & Champagne, P.C.

[57] ABSTRACT

A method of cleaning is used for cleaning a print head used in an ink type recording apparatus. The head cleaning operation includes a suction operation in which a head cleaning mechanism performs suction of the tips of ink nozzles and an ejection operation in which ink is ejected through the ink nozzles. A first cleaning operation is performed if the print head is cleaned for the first time after the power-up of the recording apparatus. A second cleaning operation is performed if the print head has been cleaned at least one time after the power-up of the recording apparatus. The first operation includes a combination of cleaning conditions and the second operation includes a combination of cleaning conditions different from the first cleaning operation. There may be a plurality of the first cleaning operations each of which includes a corresponding cleaning condition, and one of the plurality of the first cleaning operations may be selected according to an elapsed time from when the recording apparatus is turned off.

7 Claims, 6 Drawing Sheets

1
2
CPU
3
ROM
FIRST CLEANING OPERATION
SECOND CLEANING OPERATION
SUCTION DURATION
EJECTION DURATION
T1
T2
T3
T4
4
RAM
5
I/O
6
HEAD DRIVER
7
HEAD
8
MOTOR DRIVER
9
MOTOR
10
SUCTION MECHANISM
11
20
HOST APPARATUS

HOST APPARATUS
20
SUCTION MECHANISM
10
MOTOR
9
HEAD
7
HEAD DRIVER
6
MOTOR DRIVER
8
11
I/O
P1
5
RAM
4
ROM
3
CPU
2
1
12
+5V
13
14
15
16
17
18
19
A/D
A

FIG.5

| CLEANING OPERATION | VOLTAGE(V) | SUCTION DURATION | EJECTION DURATION | NUMBER OF TIMES |
|---|---|---|---|---|
| 1 | 0 ~ 0.6 | $T_1$ | $T_2$ | 3 |
| 2 | 0.6 ~ 1.2 | $T_1$ | $T_4$ | 3 |
| 3 | 1.2 ~ 1.8 | $T_1$ | $T_2$ | 2 |
| 4 | 1.8 ~ 2.4 | $T_1$ | $T_4$ | 2 |
| 5 | 2.4 ~ 3.0 | $T_1$ | $T_4$ | 2 |
| 6 | 3.0 ~ 3.6 | $T_1$ | $T_2$ | 1 |
| 7 | 3.6 ~ 4.2 | $T_1$ | $T_4$ | 1 |
| 8 | 4.2 ~ 4.8 | $T_3$ | $T_4$ | 1 |
| | 4.8 ~ 5.0 | CLEANING IS NOT PERFORMED | | |

METHOD OF CLEANING A PRINT HEAD USING A PLURALITY OF CLEANING OPERATIONS

BACKGROUND OF THE INVENTION

1. Field of the Invention

The present invention relates to a method of cleaning a print head, the method being used for an ink type recording apparatus such as ink jet printer.

2. Description of Related Art

Conventional ink type recording apparatuses, such as ink jet printers, are provided with a head cleaning mechanism which performs a head cleaning operation for a predetermined length of time and subsequently resumes a recording operation. The cleaning operation includes a suction operation and an ejection operation. The tips of the ink nozzles of the head are negatively pressurized for the suction operation, and then the ink is ejected through the nozzles for the ejection operation, thereby removing dried ink from the ink nozzles.

With the conventional method, a fixed series of cleaning steps are performed for a predetermined time length regardless of how often the printing operation is performed. Therefore, when a printing operation is performed a long time after the printer was used last time, performing such a fixed series of cleaning steps is often not enough to thoroughly remove dried ink deposited on the nozzles. This necessitates an additional operation such as forcibly removing dried ink using, for example, a fine needle.

SUMMARY OF THE INVENTION

An object of the invention is to provide a method of cleaning the nozzles where dried ink can be thoroughly removed prior to a printing operation after the printer has not been used for a long time.

A head cleaning operation is performed to remove dried ink from ink nozzles of the print head used in an ink type printer.

A head cleaning operation including a first cleaning operation and a second cleaning operation is performed to remove dried ink from ink nozzles of the print head, the method comprising:

performing a first cleaning operation if the print head is cleaned for the first time after the power-up of the recording apparatus; and performing a second cleaning operation if the print head has been cleaned at least one time after the power-up of the recording apparatus.

The first cleaning operation may include a plurality of combinations of cleaning conditions, and one of the plurality of combinations is selected according to an elapsed time from when the recording apparatus is turned off.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 5 shows a table which lists voltages on the capacitor 14, suction durations, ejection durations, and the number of times of suction and ejection operations.

DETAILED DESCRIPTION OF THE INVENTION

Preferred embodiments of the invention will be described in detail with reference to the drawings.

First Embodiment

Figure 1:
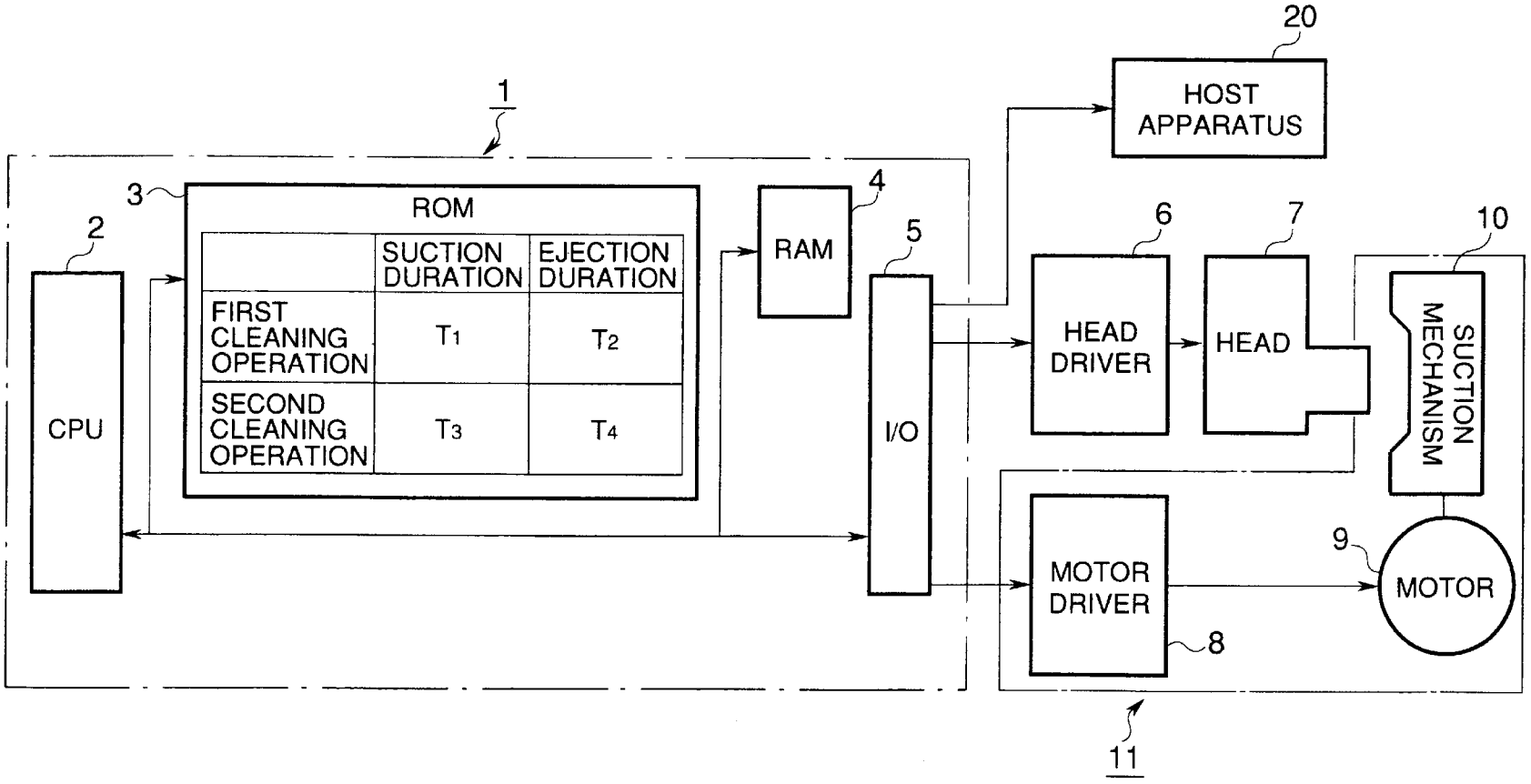
FIG. 1 is a block diagram illustrating a general construction of an ink type recording apparatus according to a first embodiment.

FIG. 1 is a block diagram illustrating a general construction of an ink type recording apparatus according to a first embodiment.

Referring to FIG. 1, a controller 1 includes a central processing unit (CPU) 2, read only memory (ROM) 3 in which control programs are stored, random access memory (RAM) 4 in which, for example, data necessary for running the control program is temporarily stored, and I/O port 5 through which data is communicated with external circuits.

Stored in the ROM 3 is a table which lists suction duration T1 and ejection duration T2 in a first cleaning operation and suction duration T3 and ejection duration T4 in a second cleaning operation. The first cleaning operation is a cleaning operation which is performed immediately before a printing operation is carried out for the first time after the printer has been turned on. The suction duration T1 and ejection duration T2 are time lengths during which the nozzles are sucked and the ink is ejected through the nozzles, respectively. The second cleaning operation is a cleaning operation which is performed prior to a printing operation following the first printing operation. The suction duration T3 and ejection duration T4 are time lengths in the second cleaning operation during which the nozzles are sucked and the ink is ejected, respectively.

The suction durations T1 and T3 and ejection durations T2 and T4 are related so that T1>T3 and T2>T4.

The I/O port 5 is connected to a head 7 via a head driver 6 and to a suction mechanism 10 via a motor driver 8 and motor 9. The suction mechanism 10 applies a negative pressure to the head 7 to perform the suction operation of the head 7.

The motor driver 8, motor 9, and suction mechanism 10 form a head cleaning mechanism 11.

Figure 2:
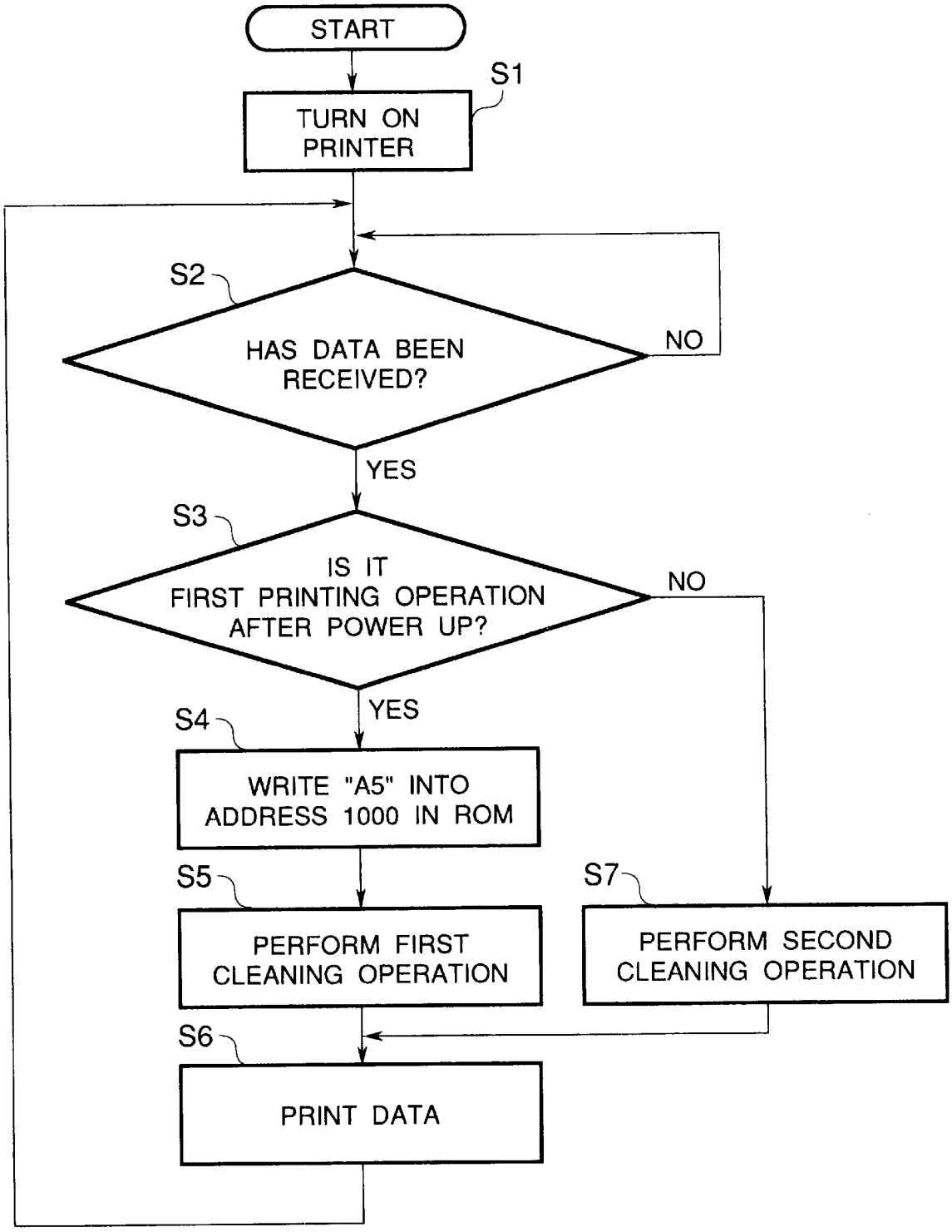
FIG. 2 is a flowchart illustrating a head cleaning operation of the ink type recording apparatus shown in FIG. 1.

FIG. 2 is a flowchart illustrating a head cleaning operation of the ink type recording apparatus shown in FIG. 1. The CPU 2 carries out the steps in the head cleaning operation under the control program.

The method of the first embodiment will be described in detail with reference to FIG. 2. At step S1, the printer is turned on. At step S2, the CPU 2 receives print data from a host apparatus 20 via the I/O port 5, and checks the data to determine whether print initiation conditions including data overflow are met. If the print initiation conditions are met, the program proceeds to step S3.

At step S3, a check is made to determine whether a printing operation is going to be performed for the first time after the printer is turned on. No particular data resides in the RAM 4 immediately after the printer is turned on and therefore, the contents in all addresses of the RAM 4 are usually, for example, $FF_h$ or $00_h$.

The CPU 2 reads the content at address 1000 in the RAM 4 and compares the content at address 1000 with a predetermined data "$A5_h$" which indicates that at least one printing operation was performed after the printer had been turned on. The suffix "h" of "$A5_h$, $FF_h$, and $00_h$" indicates that "A5" is a hexadecimal number. If the content in address 1000 is not the same as the predetermined data "$A5_h$" then the cleaning operation is determined to be the first cleaning operation and the program proceeds to step S4.

At step S4, the CPU 2 copies the data "$A5_h$" into address 1000 in the RAM 4.

At step S5, the CPU 2 causes the head cleaning mechanism 11 to perform the first cleaning operation on the head 7. The CPU 2 reads the suction duration T1 from the ROM 3 so that the motor 9 runs to suck the nozzles of the head 7 for duration T1. Likewise, the CPU 2 reads ejection duration T2 from the ROM 3 and drives the head driver 6 to eject ink for duration T2.

At step S6, the CPU 2 causes the RAM 4 to output the print data to the head driver 6, and outputs a drive command to the head driver 6, so that the head driver 6 drives the head 7 to print the data. Upon completion of the printing operation, the program jumps back to step S2.

At step S3, if the answer is NO, at least one printing operation has been performed after power up of the printer.

Thus, the program proceeds to step S7 where the CPU 2 causes the head cleaning mechanism 11 to perform the second cleaning operation. The CPU 2 reads the suction duration T3 from the ROM 3 so that the motor 9 runs to suck the nozzles of the head 7 for duration T3. Likewise, the CPU 2 reads ejection duration T4 from the ROM 3 and drives the head driver 6 to eject ink for duration T4.

In the first embodiment, the durations of the suction operation and ejection operation in the first cleaning operation are longer than those of the second cleaning operation. The first cleaning operation is effective in removing dried ink when the printer is used for the first time after a long unused period.

Second Embodiment

Figure 3:
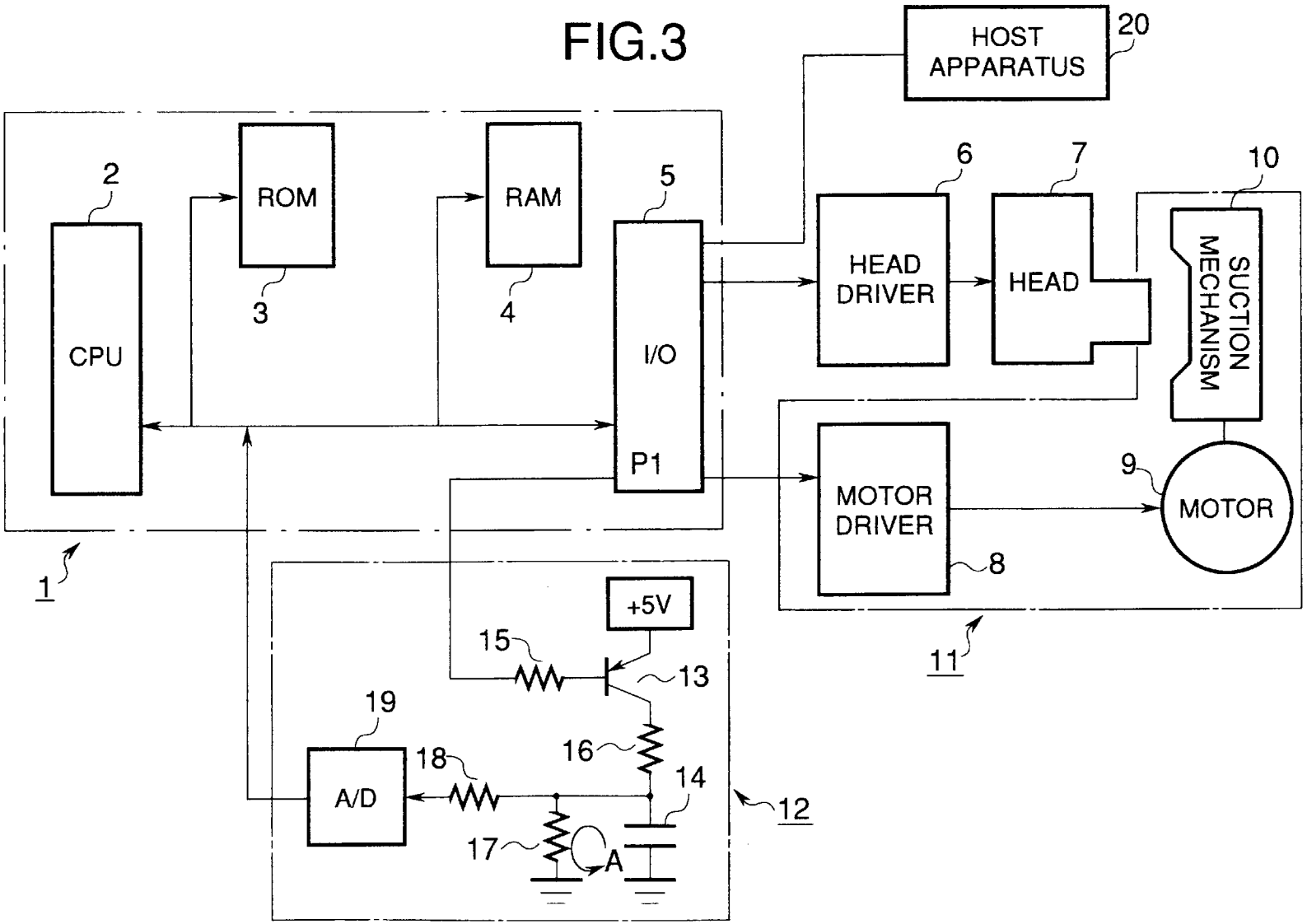
FIG. 3 is a block diagram illustrating a general construction of an ink type recording apparatus according to a second embodiment.

FIG. 3 is a block diagram illustrating a general construction of an ink type recording apparatus according to a second embodiment. The second embodiment differs from the first embodiment in that when the cleaning operation is performed for the first time after the recording apparatus is turned on, the cleaning operation is performed according to an elapsed time from when the recording apparatus was turned off. For this purpose, a timer 12 is provided for determining the time length during which the printer is not turned on and a cleaning operation according to the time length detected by the timer 12 is stored in the ROM 3.

The timer 12 includes a transistor 13, capacitor 14, resistors 15–18, and A/D converter 19. The collector of the transistor 13 is connected to the resistor 16 which in turn is in series with a parallel circuit of the resistor 17 and capacitor 14. A resistor 18 is connected between the A/D converter 19 and the junction of the resistor 16 and the capacitor 14. The transistor 13 has its emitter connected to a supply voltage of +5V and its base connected to a port P1 of the I/O port 5 via the resistor 15. The output of the A/D converter 19 is directed to the CPU 2.

The operation of the timer 12 will be described. When the printer is turned on, the output of the port PI causes the transistor 13 to turn on so that the capacitor 14 is charged by the supply voltage of +5 V via the resistor 16. When the printer is turned off, the output of the port P1 causes the transistor 13 to turn off so that the capacitor 14 starts to discharge through the resistor 17. The discharge current of the capacitor 14 flows in a direction shown by arrow A.

Figure 4:
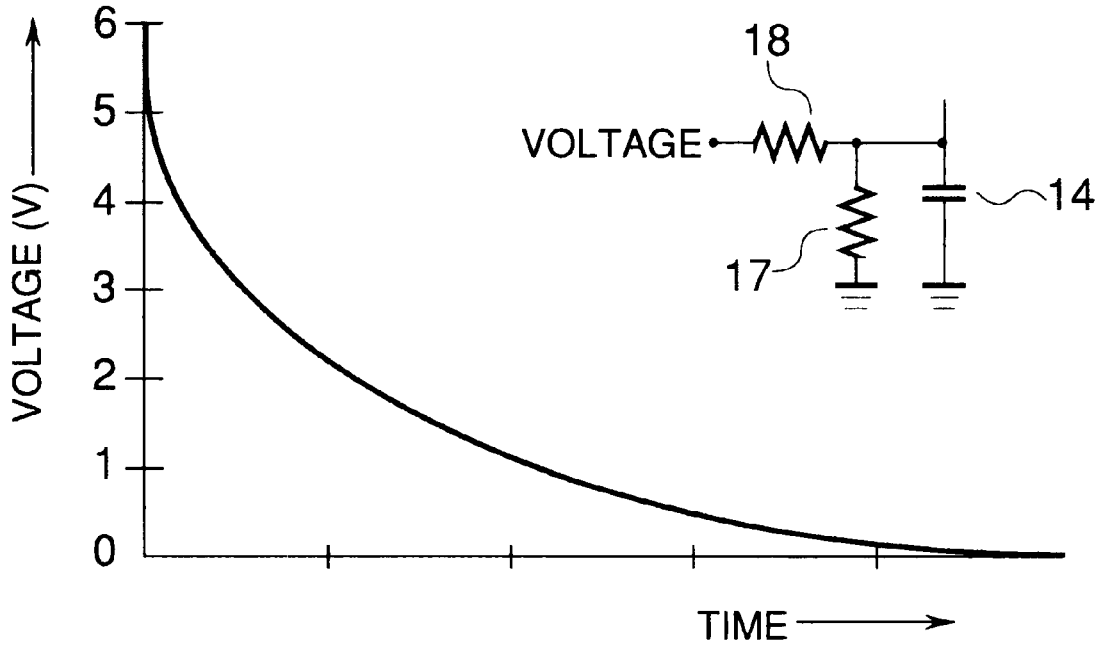
FIG. 4 illustrates the exponential changes in voltage on the capacitor 14 when the capacitor discharges through the resistor 17.

FIG. 4 illustrates the exponential changes in the voltage on the capacitor 14 when the capacitor 14 discharges through the resistor 17. The resistances of the resistors 16 and 17 are selected such that the capacitor 14 is charged much faster than it discharges through the resistor 17 and the voltage on the capacitor 14 is substantially equal to +5V when it is fully charged. The A/D converter 19 converts the voltage on the capacitor 14 into a digital value. The CPU 2 reads the output of the A/D converter 19, thereby determining the time length during which the printer is not turned on.

FIG. 5 shows a table which lists voltages on the capacitor 14, suction durations, ejection durations, and the number of times suction and ejection are performed. The voltage on the capacitor 14 is classified in a total of nine levels ranging from 0 to +5 V, each level having corresponding time lengths of suction duration and ejection duration, and the number of times the suction and ejection are performed for each level. The number of times the suction and ejection are performed is previously determined experimentally.

Figure 6:
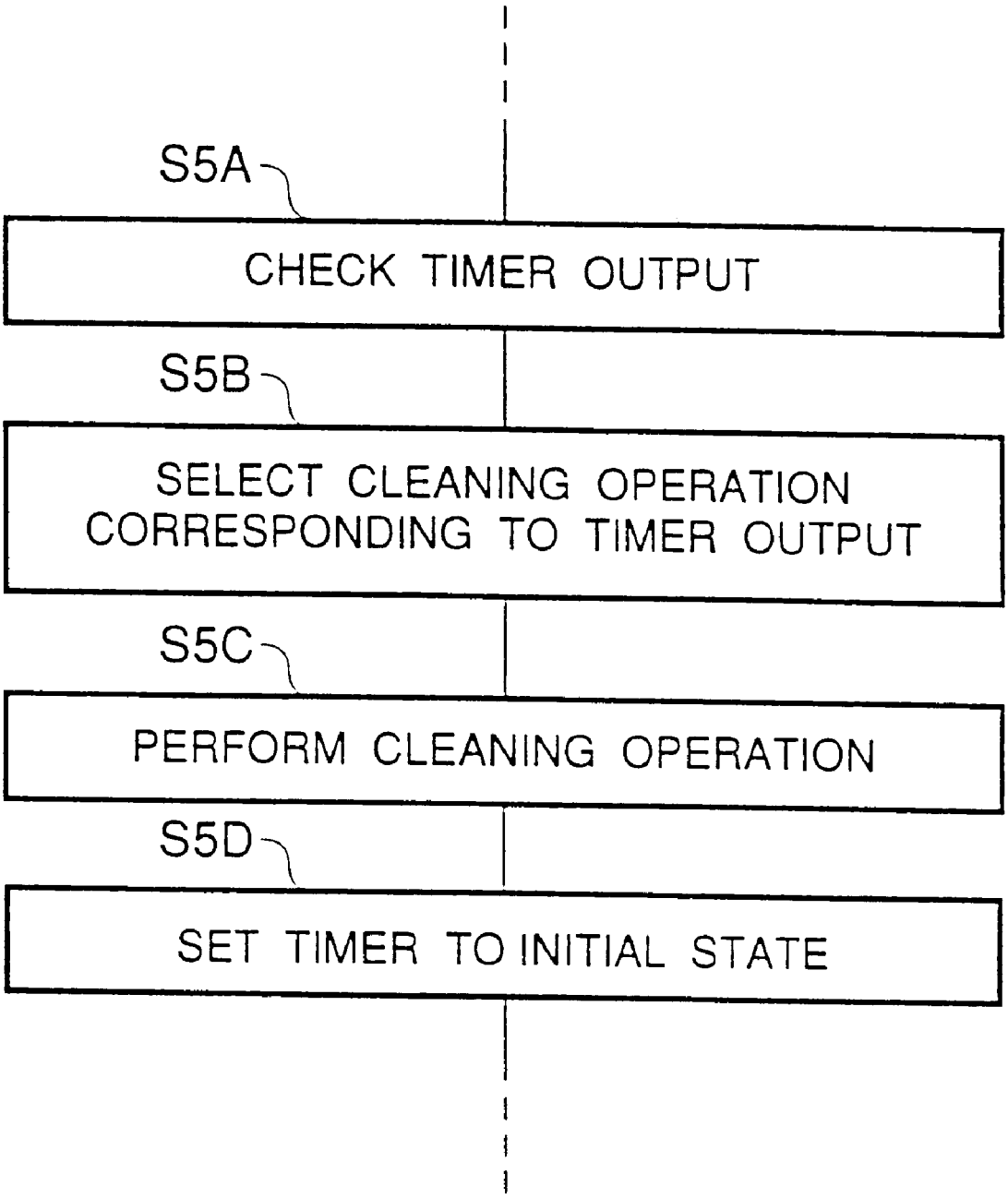
FIG. 6 is a flowchart illustrating the head cleaning operation of an ink type recording apparatus according to a second embodiment.

FIG. 6 is a flowchart illustrating the head cleaning operation of an ink type recording apparatus according to the second embodiment.

The operation of the second embodiment will now be described with reference to FIG. 6.

The operation of the second embodiment is the same as that of the first embodiment except that the first cleaning operation at step S5 in FIG. 2 is carried out differently according to the elapsed time from when the recording apparatus is turned off. Thus, the the operation of the second embodiment is described with respect to the first cleaning operation. At step S5A, the the output of the timer 12 is checked to determine an elapsed time from when the recording apparatus is turned off last time.

In other words, the CPU 2 reads the elapsed time in the form of a voltage on the capacitor 14 via the A/D converter 19 and refers to a location in the ROM 3 at step S5B to select a cleaning operation program corresponding to the length of the elapsed time. Then, the CPU 2 stores the selected cleaning operation program into the RAM 4.

At step S5C, the CPU 2 reads suction duration and ejection duration for the selected cleaning operation from the RAM 4, and performs the head cleaning operation just as in the first embodiment. The number of times the selected head cleaning operation is repeated depends on the output of the timer 12, i.e., the elapsed time since the printer was turned off.

Then, the program proceeds to step S5D where the CPU 2 sets the timer 12 to its initial state again. In other words, the CPU 2 outputs a signal to turn on the transistor 13 via the port P1, so that the capacitor 14 of the timer 12 is fully charged to +5V.

The voltage on the capacitor 14 reaches +5 V after a predetermined short time length determined by the resistors 16 and C14, and the timer 12 starts to run when a signal for turning off the transistor 13 is outputted from the port P1 upon turning off the printer. Then, the program proceeds to step S6 where the print data is printed.

In the second embodiment, when a cleaning operation is performed, a total amount of ejected ink during ejection is adjusted by changing the time length during which ink is ejected. Alternatively, the drive voltage applied to the ink pressure chambers may be changed stepwise during ejection to differently pressurize the ink, so that the dried ink deposited on the nozzles are effectively removed. For this purpose, a variety of programs for head cleaning operations may be stored in the ROM 3.

As described above, one of a plurality of cleaning operations is selected in accordance with the output of the timer 12 which indicates an elapsed time from when the timer 12 was set to its initial state. Thus, the printing operations can be started as soon as possible after the print initiation conditions are met.

What is claimed is:

1. A method of cleaning a print head used in an ink recording apparatus where a head cleaning operation is performed to remove dried ink from ink nozzles of the print head, the head cleaning operation being performed a plurality of times while the recording apparatus is turned on, the method comprising:

performing a first cleaning operation if the print head is being cleaned for a first time after a power-up of the recording apparatus;

performing a second cleaning operation if the print head has been cleaned at least one time after the power-up of the recording apparatus; and making a check to determine whether the print head is cleaned for the first time after the power-up of the recording apparatus, wherein said making a check includes:

comparing a first item of data in a first memory location with a second item of data stored in a second memory location, the first memory data indicating that the head cleaning operation has been performed at least one time after the power-up of the recording apparatus, the second item of data having a predetermined initial value;

copying the first item of data into the second memory location if the first item of data is different from the second item of data, and thereafter performing the first cleaning operation; and performing the second cleaning operation if the first item of data is the same as the second item of data.

2. A method of cleaning a print head used in an ink recording apparatus where a head cleaning operation is performed to remove dried ink from ink nozzles of the print head, the head cleaning operation being performed a plurality of times while the recording apparatus is turned on, the method comprising:

performing a first cleaning operation if the print head is being cleaned for a first time after a power-up of the recording apparatus; and performing a second cleaning operation if the print head has been cleaned at least one time after the power-up of the recording apparatus, wherein said first cleaning operation is performed longer than said second cleaning operation.

3. The method according to claim 2, wherein said first cleaning operation includes a first suction operation and a first and said second cleaning operation includes a second suction operation and a second ejection operation, the first suction operation being performed for a longer duration than the second suction operation, and the first ejection operation being performed for a longer duration than the second ejection operation.

4. A method of cleaning a print head used in an ink recording apparatus where a head cleaning operation is performed to remove dried ink from ink nozzles of the print head, the head cleaning operation being performed a plurality of times while the recording apparatus is turned on, the method comprising:

performing a first cleaning operation if the print head is being cleaned for a first time after a power-up of the recording apparatus; and performing a second cleaning operation if the print head has been cleaned at least one time after the power-up of the recording apparatus, wherein the first cleaning operation is selected from a set of a plurality of first cleaning operations, each of which has a corresponding combination of cleaning conditions, one of the plurality of first cleaning operations being performed according to an elapsed time from when the recording apparatus is turned off.

5. The method according to claim 4, wherein said cleaning conditions include a suction operation and an ejection operation, the suction operation and the ejection operation being performed a predetermined number of times according to the elapsed time, the suction operation and the ejection operation being performed for a predetermined length of time according to the elapsed time.

6. The method according to claim 4, wherein said cleaning conditions include a suction operation and an ejection operation, the suction operation and the ejection operation being performed a predetermined number of times according to the elapsed time.

7. The method according to claim 4, wherein said cleaning conditions include a suction operation and an ejection operation, the suction operation and the ejection operation being performed for a predetermined length of time according to the elapsed time.

* * * * *